US005896771A

United States Patent [19]

Müller et al.

[11] Patent Number: 5,896,771

[45] Date of Patent: Apr. 27, 1999

[54] ROLL STAND WITH A PAIR OF ROLL SUPPORT SHAFTS WITH BEARINGS AT BOTH ENDS OF THE SHAFTS

[75] Inventors: Hubert Müller, Grevenbroich; Albert Hauck, Hilchenbach, both of Germany

[73] Assignee: SMS Schloemann-Siemag Aktiengesellschaft, Dusseldorf, Germany

[21] Appl. No.: 08/954,925

[22] Filed: Oct. 21, 1997

[30] Foreign Application Priority Data

Oct. 25, 1996 [DE] Germany ..... 196 44 351

[51] Int. Cl.[6] ..... B21B 31/07; B21B 31/20

[52] U.S. Cl. ..... 72/237; 72/240; 74/399; 74/665 GA

[58] Field of Search ..... 72/237, 240, 246, 72/248, 244, 249, 449; 74/397, 399, 665 GA

[56] References Cited

U.S. PATENT DOCUMENTS

| | | | |
|---|---|---|---|
| 3,468,151 | 9/1969 | Diolot | 72/240 |
| 3,517,531 | 6/1970 | Strance | 72/244 |
| 3,657,940 | 4/1972 | Wagner | 74/397 |

FOREIGN PATENT DOCUMENTS

| | | |
|---|---|---|
| 991240 | 10/1951 | France . |
| 1059144 | 5/1954 | France . |
| 1602053 | 5/1970 | Germany . |
| 1281404 | 7/1972 | United Kingdom . |

*Primary Examiner*—Joseph J. Hail, III
*Assistant Examiner*—Rodney A. Butler
*Attorney, Agent, or Firm*—Friedrich Kueffner

[57] ABSTRACT

A pair of roll support shafts which are supported by bearings provided at both ends of the roll support shafts, wherein, between the bearings, toothed drums are mounted on the roll support shafts or the circumference of the roll support shafts is provided with toothings. Outside of the bearings, roll disks can be mounted on the ends of the roll support shafts, wherein one of the toothed drums meshes with a drive pinion mounted on a parallel drive shaft and the other toothed drum meshes with a loosely mounted intermediate pinion, wherein the drive and the intermediate pinion also mesh with each other. The roll support shafts are each supported in a free end of a single-armed tumbler lever which is swingable about the longitudinal axis of the drive pinion or the intermediate pinion, wherein the tumbler levers are supported relative to the roll stand by means of adjustable and securable rigid or elastic support members and the free ends are supported relative to each other through elastic members.

5 Claims, 2 Drawing Sheets

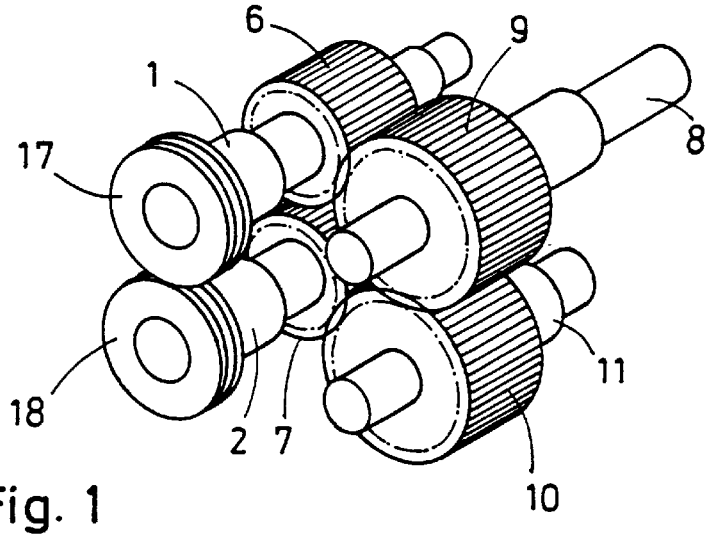
Fig. 1
Fig. 2
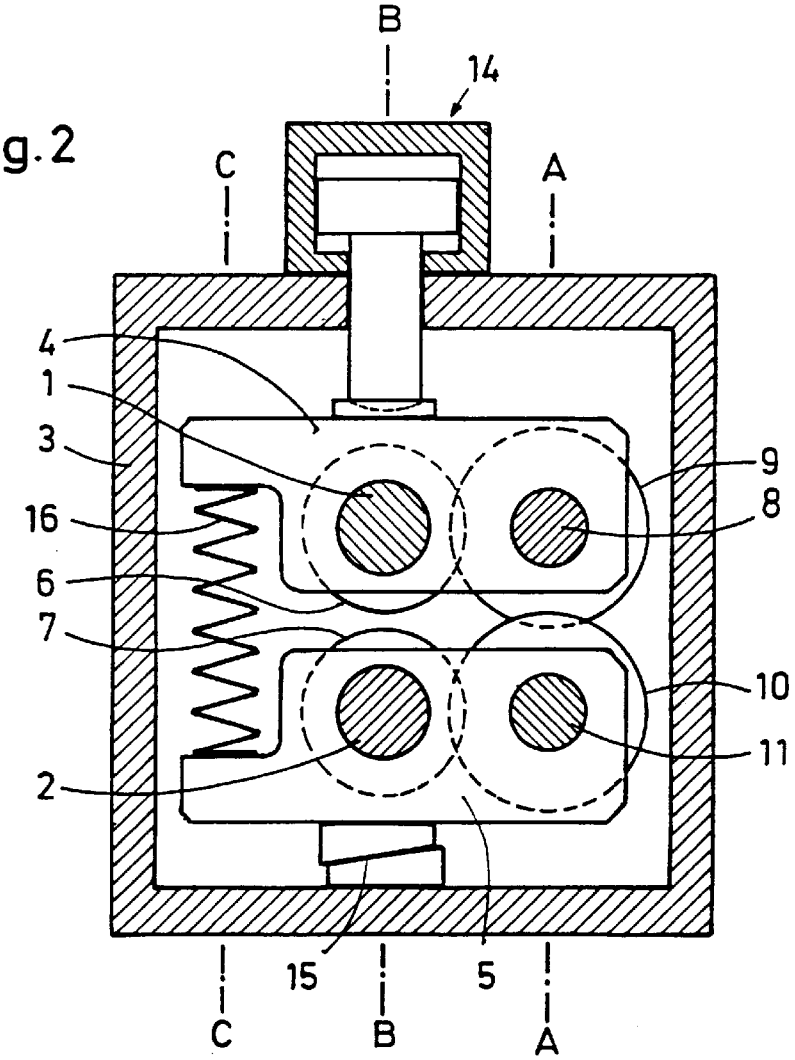

ROLL STAND WITH A PAIR OF ROLL SUPPORT SHAFTS WITH BEARINGS AT BOTH ENDS OF THE SHAFTS

BACKGROUND OF THE INVENTION

1. Field of the Invention

The present invention relates to a pair of roll support shafts which are supported by bearings provided at both ends of the roll support shafts. Between the bearings, toothed drums are mounted on the roll support shafts or the circumference of the roll support shafts is provided with toothings. Outside of the bearings, roll disks can be mounted on the ends of the roll support shafts, wherein one of the toothed drums meshes with a drive pinion mounted on a parallel drive shaft and the other toothed drum meshes with a loosely mounted intermediate pinion, wherein the drive and the intermediate pinion also mesh with each other.

2. Description of the Related Art

Roll stands of the above-described type provide the advantage that the rolls, the support shafts, the adjusting devices and the remaining roll fittings are easily accessible. However, the closed gear drive of the roll support shafts only permits the use of rolls or roll disks having relatively small diameters. This means that only small rolling forces can be applied to the rolling stock, which, in turn, means that only little spreading of the rolling stock can be effected. Also because of the small roll diameters, the roll support shafts are all supported in thin-walled, high load-bearing friction bearings. The rolls or roll disks are frequently manufactured of hard metal or hard materials in order to achieve longer service lives and better dimensional stability.

These roll stands have the significant disadvantage that, compared to roll stands with rolls supported on both sides, they have a lower stiffness which impairs especially their use as precision roll stands.

SUMMARY OF THE INVENTION

Therefore, it is the primary object of the present invention to provide a roll stand of the above-described type in which the disadvantages discussed above are eliminated.

In accordance with the present invention, the roll support shafts are each supported in a free end of a single-armed tumbler lever which is swingable about the longitudinal axis of the drive pinion or the intermediate pinion, wherein the tumbler levers are supported relative to the roll stand by means of adjustable and securable rigid or elastic support members and the free ends are supported relative to each other through elastic members.

Bending of the roll shafts depends on the rolling force which can be determined from the pressure in the piston-cylinder unit or another force measuring device and can be compensated by an appropriate adjustment of the piston-cylinder unit.

By supporting one tumbler lever by means of a rigid support member and the other tumbler lever by means of an elastic, adjustable support member, and by also elastically supporting the free ends of both tumbler levers, the tumbler levers can be balanced relative to each other and the desired adjustment of the roll support shafts can be adjusted with the rolls or the roll disks.

In accordance with another feature of the present invention, the elastic support member may be composed of a piston-cylinder unit arranged on the roll stand and the rigid support member may be composed of wedge-type adjustments or screw-type adjustments which are moveable relative to each other and are arranged between the roll stand and the tumbler lever. The adjustment of the two rolls or roll disks mounted on the roll support shafts can be controlled through an inductive distance pick-up which influences the piston-cylinder unit.

In accordance with another feature of the present invention, the tumbler levers may each be composed of a U-shaped stirrup whose two flanges, on the one hand, are received in the roll stand and, on the other hand, receive the bearings of the respective roll support shafts.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 1 is a perspective view showing a roll with roll support shafts and an adjusting device;

FIG. 2 is a schematic sectional view of a roll stand transversely of the axes of the roll support shafts;

DESCRIPTION OF THE PREFERRED EMBODIMENTS

Figure 5:
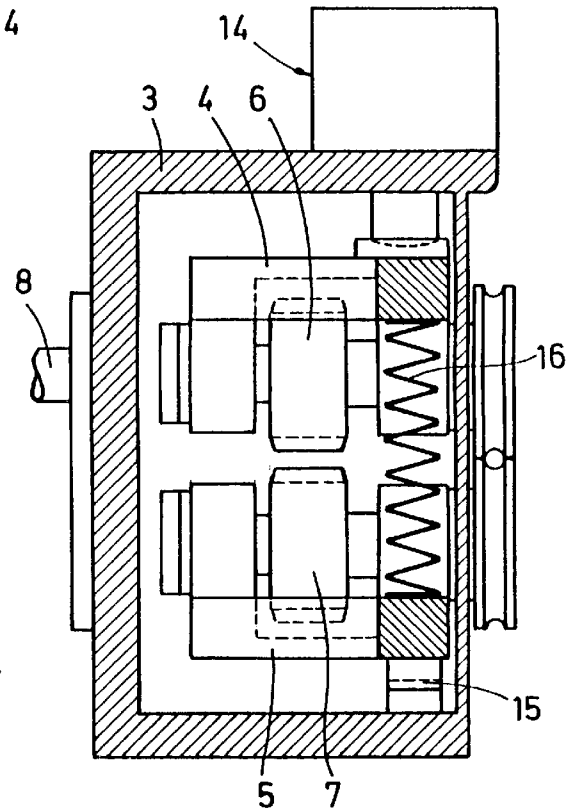
FIG. 5 is a sectional view taken along sectional line C—C of FIG. 2.
Figure 4:
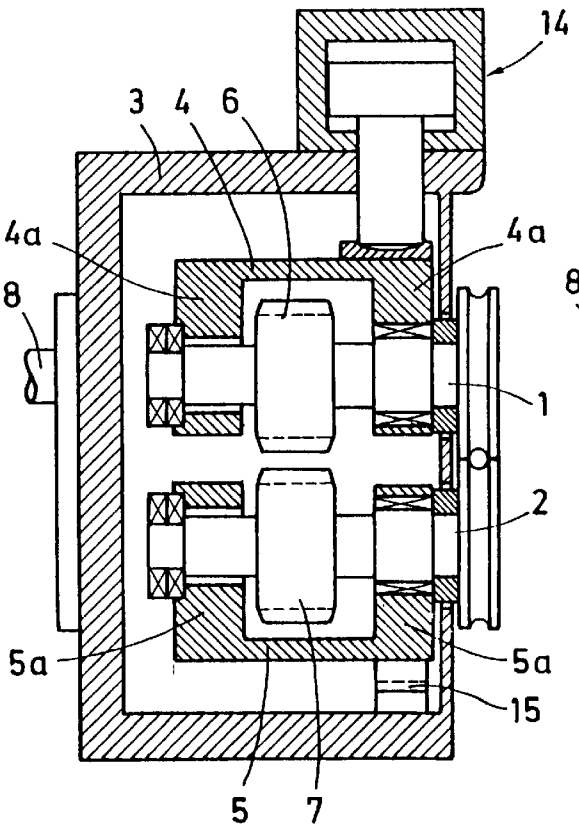
FIG. 4 is a sectional view taken along sectional line B—B of FIG. 2.
Figure 3:
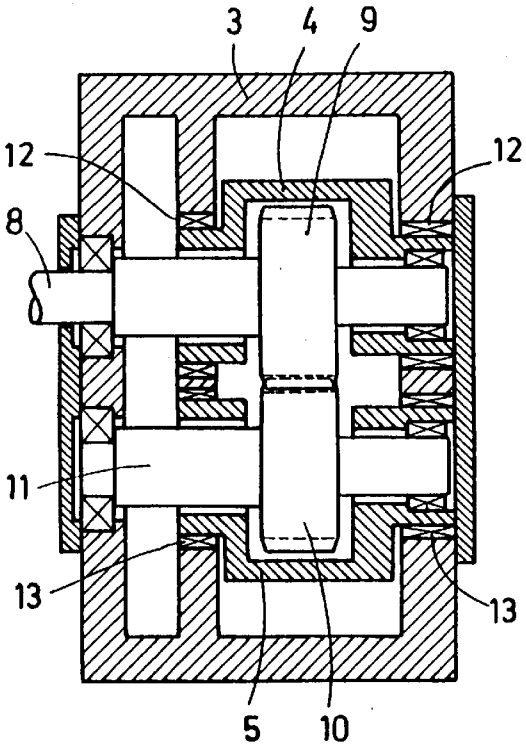
FIG. 3 is a sectional view taken along sectional line A—A of FIG. 2.

As is apparent from FIG. 1 in conjunction with FIGS. 2, 3 and 4, the roll support shafts 1 and 2 are supported in the flange projections 4*a* and 5*a* of the U-shaped tumbler levers 4 and 5, respectively, and toothed drums 6 and 7 are mounted between the bearings. The toothed drum 6 meshes with the drive pinion 9 mounted on the axis-parallel drive shaft 8, while the toothed drum 7 is mounted on the roll support shaft 2 and meshes with a loosely mounted intermediate pinion 10. The drive pinion 9 and the intermediate pinion 10, in turn, also mesh with each other.

As can be seen in FIG. 3, the two tumbler levers 4 and 5 are mounted in bearings 12 and 13 in the housing 3 of the roll stand so as to be swingable about the longitudinal axis of the drive shaft 8 or the loose axis 11 of rotation of the intermediate pinion 10, respectively. The tumbler lever 4 rests against a piston-cylinder unit 14 connected to the housing 3 of the roll stand, while the tumbler lever 5 rests against a wedge-type adjustment 15 which, in the illustrated embodiment, is composed of two wedges which can be shifted relative to each other. A spring 16 is arranged as the elastic member between the two free ends of the tumbler levers 4 and 5.

The tumbler levers 4, 5 which support the roll support shafts 1,2 with the roll disks 17, 18 and are balanced relative to each other by means of the piston-cylinder unit 14 and the spring 16 can be placed at predetermined distances relative to each other, possibly while measuring the spacing and using an inductive distance pick-up, and, thus, a predetermined distance between the two roll disks 17, 18 can be effected. By carrying out an appropriate positional control and force control of the piston-cylinder unit 14, it is possible to adjust any desired stiffness of the roll stand; in addition, quick and precise corrections of the distance, i.e., the roll gap between the roll disks 17 and 18, are possible.

While specific embodiments of the invention have been shown and described in detail to illustrate the inventive principles, it will be understood that the invention may be embodied otherwise without departing from such principles.

We claim:

1. A roll stand comprising a pair of roll support shafts having ends, bearings mounted at both ends of each roll support shaft, a toothed drum mounted on each roll support shaft between the bearings, roll disks mounted on the ends of each roll support shaft outside of the bearings, wherein one of the toothed drums meshes with a drive pinion mounted on a parallel drive shaft, and another of the tooth drums meshes with a loosely mounted intermediate pinion, and wherein the drive pinion and the intermediate pinion also mesh with each other, further comprising a first tumbler lever swingable about a longitudinal axis of the drive pinion and a second tumbler lever swingable about a longitudinal axis of the intermediate pinion, and adjustable and securable support members for supporting the tumbler levers relative to the roll stand, and wherein free ends of the tumbler levers are supported relative to each other through an elastic member, and wherein one of said adjustable and securable support members is rigid and another of said adjustable and securable support members is elastic.

2. The roll stand according to claim 1, wherein the elastic support member is comprised of a piston-cylinder unit mounted on the roll stand, and wherein the rigid support member is comprised of an adjustment means mounted between the roll stand and the first tumbler lever.

3. The roll stand according to claim 1, wherein each tumbler lever is comprised of a U-shaped stirrup having two flanges, wherein the two flanges are mounted in bearings in the roll stand and receive the bearings of the roll support shafts.

4. The roll stand according to claim 2, wherein the adjustment is a wedge-type adjustment means.

5. The roll stand according to claim 2, wherein the adjustment means is a screw-type adjustment means.

* * * * *